US011811136B2

(12) United States Patent
Xu et al.

(10) Patent No.: US 11,811,136 B2
(45) Date of Patent: Nov. 7, 2023

(54) METAMATERIALS, RADOMES INCLUDING METAMATERIALS, AND METHODS

(71) Applicant: The Florida State University Research Foundation, Inc., Tallahassee, FL (US)

(72) Inventors: Chengying Xu, Cary, NC (US); Jonathan MacDonald, Tallahassee, FL (US)

(73) Assignee: Florida State University Research Foundation, Inc., Tallahassee, FL (US)

( * ) Notice: Subject to any disclaimer, the term of this patent is extended or adjusted under 35 U.S.C. 154(b) by 302 days.

(21) Appl. No.: 17/245,488

(22) Filed: Apr. 30, 2021

(65) Prior Publication Data

US 2021/0313674 A1 Oct. 7, 2021

Related U.S. Application Data

(62) Division of application No. 16/017,206, filed on Jun. 25, 2018, now Pat. No. 11,011,834.
(Continued)

(51) Int. Cl.
*H01Q 1/42* (2006.01)
*H01Q 1/28* (2006.01)
(Continued)

(52) U.S. Cl.
CPC ..... *H01Q 1/422* (2013.01); *H01Q 1/28* (2013.01); *H01Q 1/38* (2013.01);
(Continued)

(58) Field of Classification Search
CPC ..... H01Q 1/28; H01Q 1/422; H01Q 15/0086
See application file for complete search history.

(56) References Cited

U.S. PATENT DOCUMENTS 8,765,230 B1 * 7/2014 Waldrop, III ..... H01Q 1/02 343/872
2004/0239577 A1 * 12/2004 Delgado ..... H01Q 1/422 343/872
(Continued)

FOREIGN PATENT DOCUMENTS

CN 104198060 A 12/2014
CN 106099381 A * 11/2016 ..... H01Q 15/0026
(Continued)

OTHER PUBLICATIONS

Akedo J. et al. "Ceramic Transactions, vol. 245, A Collection of Papers Presented at the 10th Pacific Rim Conference 1 Jn Ceramic and Glass Technology Jun. 2-6, 2013 Coronado, California," Advances in Multifunctional Materials and Systems 11, 2013. (135 pages).
(Continued)

*Primary Examiner* — Ab Salam Alkassim, Jr.
*Assistant Examiner* — Leah Rosenberg
(74) *Attorney, Agent, or Firm* — Eversheds Sutherland (US) LLP

(57) ABSTRACT

Metamaterials are provided that may include a first substrate including a high temperature dielectric material, and a first array of conductive resonators arranged on the first substrate. The conductive resonators may include a noble metal, a noble metal alloy, a high temperature ceramic semiconductor, or a combination thereof. Radomes including metamaterials also are provided.

19 Claims, 11 Drawing Sheets

Related U.S. Application Data

(60) Provisional application No. 62/525,617, filed on Jun. 27, 2017.

(51) Int. Cl.

| | |
|---|---|
| ***H01Q 5/00*** | (2015.01) |
| ***H01Q 13/02*** | (2006.01) |
| ***H01Q 1/38*** | (2006.01) |
| ***H01Q 15/02*** | (2006.01) |
| ***H01Q 15/00*** | (2006.01) |

(52) U.S. Cl.
CPC ..... *H01Q 15/0086* (2013.01); *H01Q 15/02* (2013.01); *H01Q 13/02* (2013.01)

(56) References Cited

U.S. PATENT DOCUMENTS

| | | | | |
|---|---|---|---|---|
| 2008/0129626 | A1 | 6/2008 | Wu et al. | |
| 2009/0096545 | A1 | 4/2009 | O'Hara et al. | |
| 2009/0219623 | A1 | 9/2009 | Shalaev et al. | |
| 2010/0104823 | A1* | 4/2010 | Hyde | H01Q 15/0086 427/256 |
| 2011/0199281 | A1 | 8/2011 | Morton et al. | |
| 2015/0152013 | A1* | 6/2015 | Liu | B32B 18/00 427/58 |
| 2015/0192721 | A1* | 7/2015 | El-Kady | H01Q 15/0086 359/352 |
| 2015/0255877 | A1* | 9/2015 | Liu | H01Q 15/02 343/909 |
| 2016/0164184 | A1* | 6/2016 | Li | H01Q 1/52 343/752 |

FOREIGN PATENT DOCUMENTS

| | | | | |
|---|---|---|---|---|
| CN | 106116585 A | * | 11/2016 | C04B 35/565 |
| CN | 109532143 B | * | 9/2021 | B32B 15/00 |

OTHER PUBLICATIONS

Alu, A, "Pairing an Epsilon-Negative Slab With a Mu-Negative Slab: Resonance, Tunneling and Transparency," IEEE Transactions on Antennas and Propagation, vol. 51, No. 10, Oct. 2003 (14 pages).

Bilotti, F., "Equivalent-Circuit Models for the Design of Metamaterials Based on Artificial Magnetic Inclusions," IEEE Transactions on Microwave Theory and Techniques, vol. 55, No. 12, Dec. 2007 (9 pages).

Chen, H., "Equivalent Circuit Model for Left-Handed Metamaterials," J_ Appl. Phys. 100 (2006): https://doi.Jrg/10.1063/1.2219986 (7 pages).

Cory, H., "Use of Conjugate Dielectric and Metamaterial Slabs as Radomes," Special Issue on Metamaterials LHM, The Institution of Engineering and Technology (2007) (7 pages).

Cory, H., "Wave Propagation in Metamaterial Multi-Layered Structures," Microwave and Optical Technology Letters, vol. 40, No. 6, Mar. 2004 (6 pages).

Kandi, K. K., "Development of Silicon Nitride-Based Ceramic Radomes—A Review," Int. J_ Appl. Ceram. Techol. 2015) (12 pages).

Pendry, J.B., "Negative Refraction Makes a Perfect Lens," The American Physical Society, Physical Review Letters, vol. 85, No. 18, Oct. 2000 (4 pages).

Svirko, Y., "Layered Chiral Metallic Microstructures with Inductive Coupling," Appl. Phys. Lett. 78, (2001) (4 pages).

* cited by examiner

METAMATERIALS, RADOMES INCLUDING METAMATERIALS, AND METHODS

CROSS-REFERENCE TO RELATED APPLICATIONS

This application is a divisional of U.S. application Ser. No. 16/017,206, filed Jun. 25, 2018, which claims priority to U.S. Provisional Patent Application No. 62/525,617, filed Jun. 27, 2017, which are incorporated herein by reference.

BACKGROUND

Inflight radomes and antennas are essential components on modern aircrafts and missiles. Antennas can allow for communication and targeting, and a radome generally protects antennas from elements while typically allowing low loss EM transmission. Aerodynamic heating can pose significant challenges regarding structural design and materials selection for hypersonic flights.

During hypersonic flight operations (e.g., at velocities greater than Mach 5), due to aerodynamic drag, the expected temperature of the outer surface of a radome wall can exceed 1,000° C. within several-minutes of flight time (see, e.g., Nair, R. et al., Progress in Electromagnetics Research, 2015, 154, 65-78). The electromagnetic (EM) window regions of a typical nose-cone radome structure, corresponding to antenna scan ranges, can include one or more regions that reach up to 1400° C. (Id.), which can cause most natural ceramic materials to become conductors. Therefore, the flexural strength, dielectric constant, and/or loss tangent of ceramic materials are factors that typically are considered in the selection of radome materials.

Hypersonic flights can lead to high temperature flows, air dissociation, and/or cumulative heating of air-frames. The dynamic range of parameters that characterize the environment is large and influenced by many factors, including altitude, velocity, duration of flight, geometry of the vehicle, airframe, and/or the heat-shielding of the material. For instance, the electron density and electrical conductivity of vehicle components can vary by several orders of magnitude due to heating/cooling cycles during the course of a flight. Some of the in-flight issues encountered include signal attenuation, communication blackout, signal distortion due to turbulent flow, radiation from heated optical windows, and emission from hot flows. These conditions can require the design and selection of radome materials for hypersonic vehicle to possess high flexural strength, low dielectric constant, and/or low loss tangent, etc.

Typical materials used in radome structures include PYROCERAM® glass-ceramic material and slip cast fused silica (SCFS). These materials, however, have one or more inherent limitations. For example, a disadvantage of PYROCERAM® glass-ceramic material is that its dielectric constant and loss tangent increase with temperature, thereby preventing its use at temperatures greater than 800° C. A disadvantage of SCFS includes the porous nature of the material and its limited mechanical properties. Also, SCFS, due to their density, can transmit water vapor readily from the atmosphere into the interior of a radome (see, e.g., Poisl, W. H. et al., Raytheon Technology Today, 2012, 2, 64-65). This shortcoming also can be experienced by traditional honeycomb radome material structures.

One desirable functional requirement of radome materials can include the ability to avoid significantly altering the amplitude and/or phase of incoming radio frequency (RF) waves that pass through the materials. The transparency of the materials to RF waves typically is assured by selecting dielectrics with a small dielectric constant ($\varepsilon_r$=1.1-4.0), low dielectric loss tangent (tan $\delta$<0.01), and/or by suitable electrodynamic design of the layer thickness (see, e.g., Kandi, K. K. et al., Int'l J. Applied Ceramics Technology, 2015, 12, 909-920).

When radome materials are poorly designed, one or more disadvantages may result. For example, when dielectric materials are used that have a positive permittivity greater than one (typically, greater than 2.1), the radome can reduce the transmitted power by reflecting energy at the material interface, and the refracted waves ultimately may corrupt the beam profile (see, e.g., U.S. Pat. No. 8,350,777). As a further example, when an RF wave propagates from free space into a radome material, a difference in characteristic impedance between free space and the radome material may cause reflections of RF waves off of the surface of the dielectric material. This reflection also may occur as the wave propagates from the dielectric material back into free space on an other side of the radome. Both of these reflections can contribute to loss in transmitted signal power and decreased sensitivity in radar applications.

Typical RF transparent materials currently are designed to have favorable electrical properties either through chemical doping, skin coating, or intricate geometrical design (e.g., layered structure, porous structure, honeycomb structure, etc.). Such conventional dielectric materials, however, typically suffer from poor mechanical strength and/or relatively low operating temperatures, thereby limiting their use in many applications, such as hypersonic vehicle, spacecraft, or inside a gas turbine. Monolithic ceramic materials currently used normally exhibit high dielectric constants at high temperature, and are used at the cost of significant attenuation to incoming and outgoing radio signals.

Metamaterials are artificial materials engineered to provide one or more properties which may not be readily available in nature. Metamaterials may achieve the one or more properties from their structure (rather than their composition) by the inclusion of small inhomogeneities, which may permit effective macroscopic behavior. Metamaterials may have electromagnetic (EM) wave-manipulating capabilities (e.g., blocking, absorbing, enhancing, and/or bending) beyond those of conventional materials Metamaterials typically include individual cells periodically replicated in the X and Y planes, and may be stacked in the Z plane (see, e.g., U.S. Pat. No. 8,350,777). A wide range of phenomena, such as permittivity e and permeability p values, can be created by varying the geometric parameters and electrical properties of the conductive portion of the structure, which may account for a very small fraction of the entire volume. For example, in 1999, a metallic magnetic resonance element was designed that included a split-ring resonator (SRR), where the volume fraction of the metallic ring was only 1:104 to the entire structure (Pendry, J. B. et al., Applied Physics Letters, 2001, 78, 298). Because the conductive portion may be so small, possible RF absorption can generally be neglected (Saini, P. et al., New Polymers for Special Applications (Chapter 3), 2012). Additionally, with such structure designs, reflection loss at the material boundary interface can be eliminated (Tanaka, T. et al., Physical Review B, 2006, 73, 125423). In general, the higher the electrical conductivity of a metallic resonator, the higher the efficiency, since the structure tends to "pull" the electric field into its interior (Ebberg, A. et al., Advances in Multifunctional Materials and Systems II: Ceramic Transactions, 2014, 245). Other structures (e.g., inductive coupled rod pairs, double-fishnet structure) have also been studied and proposed, especially for higher frequency applications (see, e.g., "Svirko, Y. et al., Applied Physics Letters, 2001, 78, 498; and Podolskiy, V. A. et al., Nonlinear Opt. Phys. Mater., 2002, 11, 65).

Computer simulations have determined that pairing an ε-negative slab with a p-negative slab may lead to unusual features, such as zero reflection and near-perfect transparency (Alu, A. et al., IEEE Transactions on Antennas and Propagation, 2003, Vol. 51, No. 10). Therefore, a structure including a conventional dielectric slab adjacent to a metamaterial slab of the same width but of opposite material characteristics may be used as a radome structure to provide desirable transparency in normal incident angle, and reduce the reflection for oblique incidence. One advantage of such structures may be that it is independent of the phase of incoming RF waves, since the phase after propagating through the first slab of each pair is cancelled after passing through the second slab of the pair (Cory, H. et al., Microwave and Optical Technology Letters, 2004, 40, 6; and Cory, H. et al., Antennas and Propagation, 2007, 1, 1).

The so-called RF transmission in metamaterials generally is not considered transmission; instead it is typically considered to be RF signal propagation by resonance, and, therefore, is not usually based on the inherent properties of the components materials' make-up. For example, a split-ring resonator (SRR) structure, which is a representative metamaterial type, is able to create strong electrical-magnetic field coupling, and produce desired values of frequency-dependent effective permittivity $\varepsilon_{eff}$ and permeability $\mu_{eff}$, especially the values over a narrow frequency band around its resonance frequency for transmission purposes.

In the past, full-wave electromagnetic solvers have been used theoretically or experimentally to investigate SRR behavior, but usually require very large computer memory space and/or very long computer processing time. Sufficiently accurate equivalent lumped circuit models (ELCM), however, can now be used effectively to estimate the behavior of SRR structures in a simple, fast, and/or computationally efficient manner. Establishing explicit relationships between the physical properties (e.g., electrical properties, geometric parameters, etc.) of the SRR structure and its frequency-dependent transmission/reflection behavior is now easier to achieve. Systematic optimization can be performed with such circuit model representation as well.

When designing a metamaterial structure, e.g., the aforementioned SRR configuration, in order to achieve a theoretically-proven electromagnetically induced transparency (EIT), one major task can be to eliminate the dissipation due to Ohmic losses. For example, a coupled rectangle-shaped SRR can be modeled as two damped mass-spring resonators with mass $m_1=m_2$ and spring constant κ linearly coupled by a third spring $\kappa_c$ (Tassin, P, et al., Physical Review Letters, 2009, 102, 053901). The dissipation minimum may occur approximately at the resonance frequency, when the metamaterial exhibits a transmission window with extremely low absorption. With such modeling methods, low loss RF transmission may be achieved through electromagnetically induced transparency (EIT) in coherent three-level atomic media.

Existing metamaterial designs generally include metal (copper, gold, etc.) resonators arranged on polymer dielectric substrates, and, as a result, and are typically not suitable for high temperature applications.

There remains a need for metamaterials capable of meeting the one or more requirements imposed by high-speed projectiles, such as missiles, or vehicles, including materials that are suitable for all-weather conditions and/or possess a low dielectric constant and loss tangent, both of which may have values that are desirable throughout at least a portion of a temperature range of interest (e.g., >1,000° C.).

BRIEF SUMMARY

In one aspect, metamaterials are provided. In some embodiments, the metamaterials include a first substrate including a high temperature dielectric material, and a first array of conductive resonators arranged on the first substrate, wherein the conductive resonators include a noble metal, a noble metal alloy, a high temperature ceramic semiconductor, or a combination thereof.

In some embodiments, the metamaterials include a first substrate including a high temperature dielectric material; a first array of conductive resonators arranged on the first substrate; a second substrate including the high temperature dielectric material; and a second array of the conductive resonators arranged on the second substrate; wherein the first substrate and the second substrate are arranged substantially parallel to each other; and wherein the conductive resonators include a noble metal, a noble metal alloy, a high temperature ceramic semiconductor, or a combination thereof.

In another aspect, radomes that include a metamaterial are provided. In some embodiments, the radomes include a metamaterial, wherein the metamaterial includes (i) a first substrate including a high temperature dielectric material; and (ii) a first array of conductive resonators arranged on the first substrate, wherein the conductive resonators include a noble metal, a noble metal alloy, a high temperature ceramic semiconductor, or a combination thereof. In some embodiments, the radomes include a metamaterial, wherein the metamaterial includes (i) a first substrate including a high temperature dielectric material; (ii) a first array of conductive resonators arranged on the first substrate; (iii) a second substrate including the high temperature dielectric material; and (iv) a second array of the conductive resonators arranged on the second substrate; wherein the first substrate and the second substrate are arranged substantially parallel to each other, and wherein the conductive resonators include a noble metal, a noble metal alloy, a high temperature ceramic semiconductor, or a combination thereof.

DETAILED DESCRIPTION

Figure 1A:
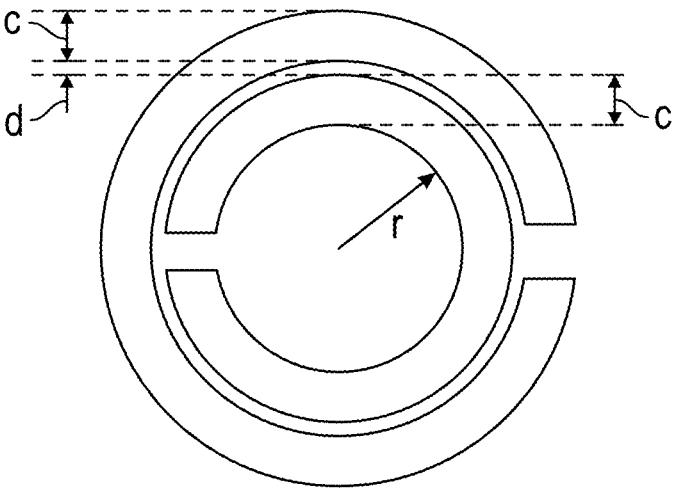
FIG. 1A depicts an embodiment of a conductive resonator having a split ring structure.

Provided herein are metamaterials and radomes that include metamaterials, which can be used in high temperature, pressure, and/or radioactive environments, while maintaining a desirable degree of radiofrequency (RF) transparency. In some embodiments, the metamaterials are thermally stable, low loss transmission metamaterials suitable for use in or as hypersonic flight radomes at multiple frequency bands (e.g., 3-30 GHz).

Radomes are provided that include a metamaterial as described herein, and the metamaterials may have an effective refractive index close to unity with low losses. Not wishing to be bound by any particular theory, it is believed that having an effective refractive index close to unity can ensure that the refracted angle is the same as the incident angle, which can permit the beam profile to be maintained. Not wishing to be bound by any particular theory, it is believed that the low loss transmission may minimize the effect of reflection, absorption, and scattering when an RF signal passes through a metamaterial, thereby possibly providing near perfect transparency.

Embodiments of the metamaterials can be used as a window tile for radome applications. In some embodiments, radio communications can easily pass through the metamaterials and radomes described herein with minimum gain loss and phase distortion. In some embodiments, the metamaterials described herein are stable at temperatures in excess of at least 1400° C., while maintaining mechanical strength and/or retaining a low dielectric constant for desired RF transmission properties. Embodiments of the radomes are relatively light weight, and have high stiffness, high strength, and/or high oxidation resistance. In some embodiments, refracted and reflected EM signals (from a seeker antenna) propagate along and within the radomes' surface toward the nose cone direction, and, therefore, the boresight error $\varepsilon_{bse}$ can be completely eliminated during a final homing period to ensure accurate engagement.

Metamaterials

Provided herein are metamaterials. In some embodiments, the metamaterials include a first substrate, and a first array of conductive resonators arranged on the first substrate.

In some embodiments, the metamaterials are substantially RF transparent. A material is "RF transparent" if an EM signal (within a certain frequency range) can pass through the material with no (i) amplitude reduction, (ii) phase distortion, or (iii) a combination thereof. When the amplitude reduction or the phase distortion changes by 10% or less, then the material has "near-perfect RF transparency".

In some embodiments, the metamaterials include a first substrate, a first array of conductive resonators arranged on the first substrate, a second substrate, and a second array of the conductive resonators arranged on the second substrate. In some embodiments, the first substrate and the second substrate are arranged substantially parallel to each other. The substrates may be fixed in position by any known techniques or materials, particularly materials that are thermally and/or chemically stable at temperatures described herein. As used herein, two substrates are "substantially parallel" when the surfaces of the substrates are parallel to each other, or the smaller of any two distances between the surfaces of the substrates is within 5% of the larger of the two distances (e.g., 100 units and 96 units).

As used herein, the phrase "array of conductive resonators" generally refers to two or more conductive resonators that are arranged on a substrate in a pattern of any kind. Typically, the conductive resonators of an array are not in contact with each other. In some embodiments, the spacing between the conductive resonators is sub-wavelength, which can provide efficient scattering, prevent the occurrence of grating diffraction, or a combination thereof. In some embodiments, the spacing between the conductive resonators is great enough to prevent near-field coupling between neighboring conductive resonators from perturbing the designed scattering amplitudes and phases.

Figure 8A:
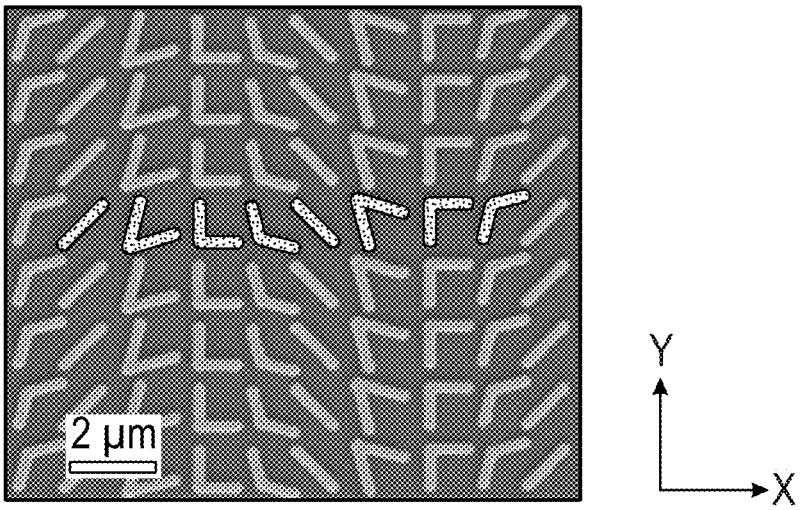
FIG. 8A depicts a scanning electron microscope (SEM) image of an embodiment of an antenna array fabricated on a silicon wafer.
Figure 8B:
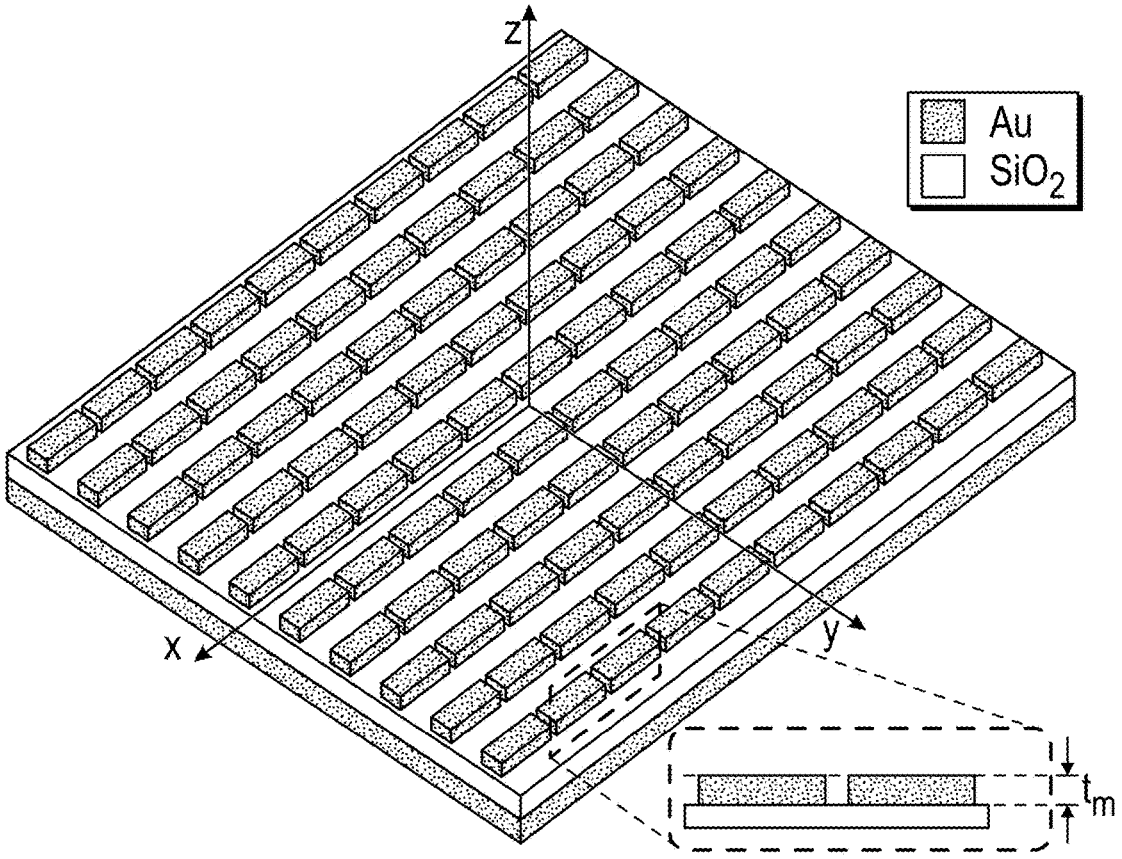
FIG. 8B depicts a 3D view of an embodiment of a multilayered structure including an anisotropic homogeneous metasurface.

The two or more conductive resonators of an array may have the same or different shapes (e.g., a straight nanorod, a bent nanorod, a split circle, etc.). The pattern may include a symmetrical matrix (e.g., FIG. 1C, FIG. 2C, FIG. 8A, and FIG. 8B). A "symmetrical matrix" is a pattern in which the conductive resonators are aligned in at least one of the X and Y directions. The X, Y, and Z axes of the metamaterials are depicted at FIG. 8B.

In some embodiments, the conductive resonators of the arrays are at RF range (e.g., 3-30 GHz) with sub-wavelength separation, which can make it possible to achieve the phase discontinuities phenomenon along a material's surface, thereby ensuring that the reflected and refracted signals are plane waves. Not wishing to be bound by any particular theory, it is believed that spatially tailoring the geometry of the resonators (and thereby their frequency operating range) and the shape of the functional-tunable waveguide, the phase discontinuity can be designed to propagate along a surface of an object, such as a missile body, and the wavefront of the reflected and refracted signals can be guided toward the nosecone of the object.

When a metamaterial includes more than one substrate, the substrates may be arranged so that the conductive resonators of the first array and the conductive resonators of the second array are substantially aligned in the Z direction. When a first conductive resonator of a metamaterial is viewed in the Z direction, a second conductive resonator is "substantially aligned in the Z direction" with the first conductive resonator when no more than 10% of the surface area of the second conductive resonator would be viewable (in the absence of the substrate). In some embodiments, the conductive resonators of the first array and the conductive resonators of the second array are not aligned in the Z direction.

The metamaterials provided herein may be stable at relatively high temperatures, including, for example, temperatures of at least 1,000° C. In some embodiments, the metamaterials are thermally stable at a temperature of about 1,000° C. to about 1,800° C. In some embodiments, the metamaterials are thermally stable at a temperature of about 1,100° C. to about 1,800° C. In some embodiments, the metamaterials are thermally stable at a temperature of about 1,200° C. to about 1,800° C. In some embodiments, the metamaterials are thermally stable at a temperature of about 1,000° C. to about 1,800° C. In some embodiments, the metamaterials are thermally stable at a temperature of about 1,300° C. to about 1,800° C. In some embodiments, the metamaterials are thermally stable at a temperature of about 1,400° C. to about 1,800° C. In some embodiments, the metamaterials are thermally stable at a temperature of about 1,500° C. to about 1,800° C. In some embodiments, the metamaterials are thermally stable at a temperature of about 1,600° C. to about 1,800° C.

Substrates

The substrates generally may include any material that is compatible with the conductive resonators. The substrate may include materials that are good insulators at high temperatures, have desirable chemical stability at high temperatures, having desirable thermal stability at high temperatures, or a combination thereof.

In some embodiments, the substrates include a high temperature dielectric material. As used herein, the phrase "high temperature dielectric material" generally refers to dielectric materials that are thermally stable at temperatures of at least 1,000° C. When a metamaterial includes two or more substrates, each of the substrates may include the same materials, or each of the substrates may include at least one different material.

In some embodiments, the high temperature dielectric material includes alumina ($Al_2O_3$), yttria ($Y_2O_3$), silicon nitride ($Si_3N_4$), or a combination thereof. In some embodiments, the high temperature dielectric includes alumina. In some embodiments, the high temperature dielectric includes yttria. In some embodiments, the high temperature dielectric includes silicon nitride.

The substrates generally may have any dimensions, and the dimensions may be selected based on a particular application.

Conductive Resonators

The conductive resonators may generally include a conductive material. In some embodiments, the conductive resonators include a noble metal, a noble metal alloy, a high temperature ceramic semiconductor, or a combination thereof.

The noble metal may be selected from ruthenium (Ru), rhodium (Rh), palladium (Pd), silver (Ag), osmium (Os), iridium (Ir), platinum (Pt), or gold (Au). In some embodiments, the noble metal is platinum. In some embodiments, the noble metal is iridium. The noble metal alloy may be selected from any combination of two or more of the noble metals. In some embodiments, the noble metal alloy includes a platinum-rhodium alloy. Platinum-rhodium alloys can be stable in air at temperatures of at least 1600° C. to 1800° C.

In some embodiments, the noble metals or noble metal alloys (e.g., Pt—Rh alloy) may be deposited as conductive resonator patches on a substrate including alumina by screen printing powder slurries, followed by high temperature baking (up to 2000° C.).

As used herein, the phrase "high temperature ceramic semiconductor" generally refers to ceramic semiconductor materials that are thermally stable at temperatures of at least 1000° C. In some embodiments, the high temperature ceramic semiconductor includes silicon carbide (SiC). SiC may be stable at temperatures of at least 1700° C.

The conductive resonators generally may have any shape and any dimensions that permit the metamaterials to achieve one or more of the features described herein.

In some embodiments, the conductive resonators include nanorod conductive resonators. As used herein, the phrase "nanorod conductive resonator" generally refers to conductive resonators having a rod- or bent rod-shape, and a longest dimension (e.g., length) of at least 10 nm; for example, a longest dimension of about 10 nm to about 4,000 nm. In some embodiments, the nanorods have a longest dimension of about 1,000 nm to about 3,000 nm, or about 1,000 nm to about 2,000 nm. Examples of nanorods having a bent rod-shape are depicted at FIG. 8A, which includes nanorods bent at acute angles, obtuse angles, or right angles. Not wishing to be bound by any particular theory, it is believed that it is possible to fabricate complex-structured subwavelength units at a millimeter and micron-size range with current fabrication technologies, which may accommodate the GHz wave range, such as Super High Frequency (SHF, 3-30 GHz) (EM spectrum with wavelength of 1-10 cm ($1/100^{th}$ wavelength 0.1-1 mm)).

In some embodiments, the conductive resonators include at least one split ring conductive resonator. As used herein, the phrase "split ring conductive resonator" refers to conductive resonators that, when viewed along the Z-axis, form a "ring" having one or more gaps. The "ring" may be circular in shape (e.g., FIG. 1A and FIG. 2A), but other shapes, such as square or rectangles, are possible (e.g., FIG. 3A). The "ring" may have one gap (e.g., FIG. 1A), two gaps (e.g., FIG. 2A), or more than two gaps (e.g., four gaps, as depicted at FIG. 3A). The split ring conductive resonators also may include two or more "rings", such as the concentric rings depicted at FIG. 1A.

Figure 1B:
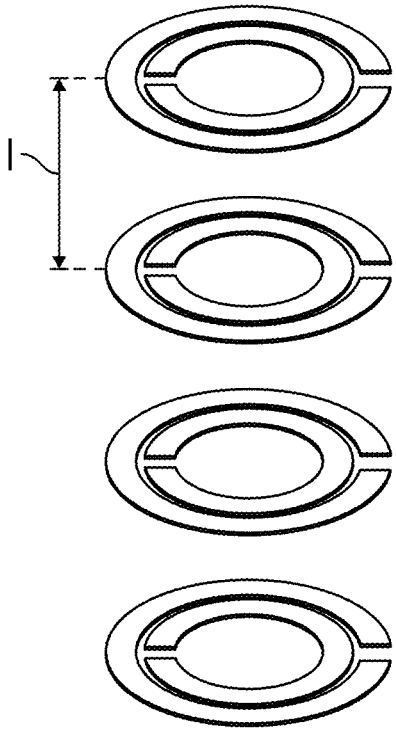
FIG. 1B depicts a stacking sequence of the conductive resonator of FIG. 1A.
Figure 1C:
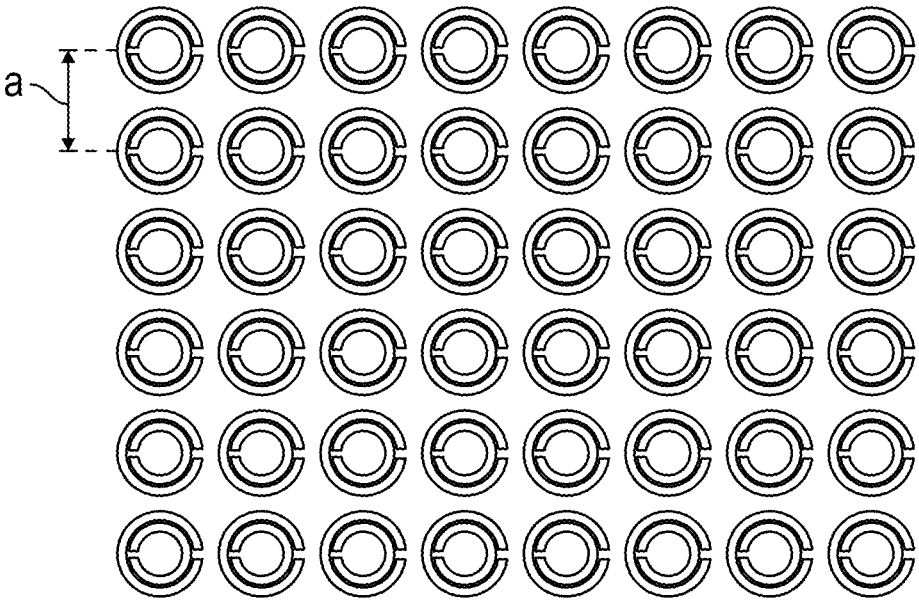
FIG. 1C depicts an array of the conductive resonator of FIG. 1A.

FIG. 1A depicts an in-plane view of an embodiment of a split ring conductive resonator, which may be arranged in a metamaterial in the stacking sequence depicted at FIG. 1B. FIG. 1C is an in-plane view of an embodiment of an array of split ring conductive resonators, each having an inner radius (r) of 2.0 mm, a width of 1.0 mm, a spacing between ring edges of 0.1 mm, and a lattice constant of 10.0 mm.

Figure 2A:
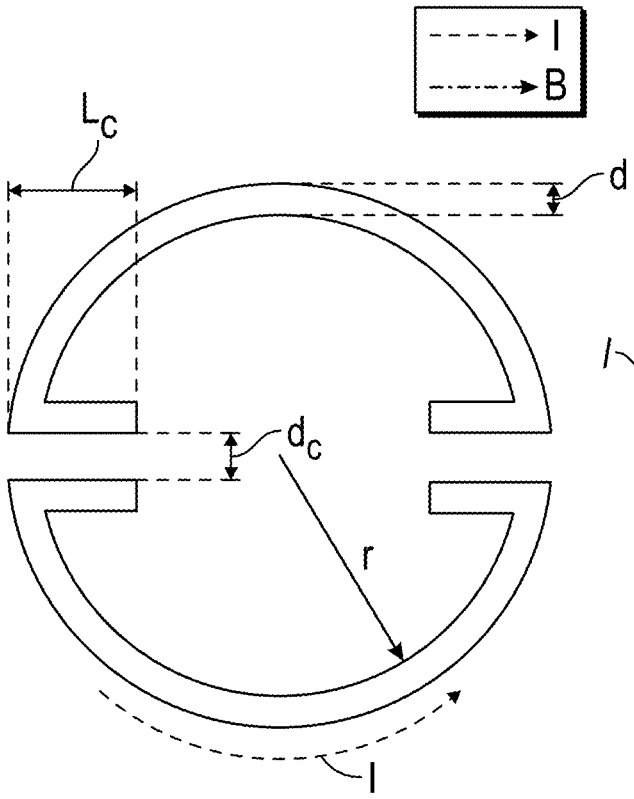
FIG. 2A depicts an embodiment of a conductive resonator having a split ring structure.
Figure 2B:
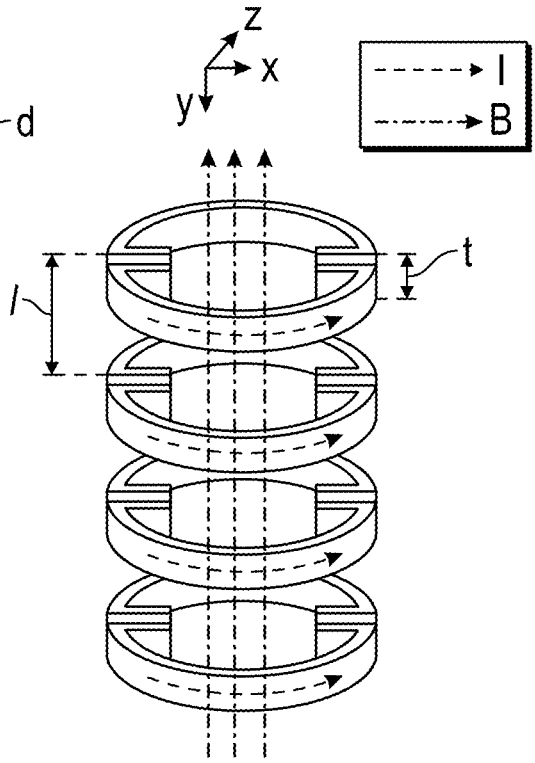
FIG. 2B depicts a stacking sequence of the conductive resonator of FIG. 2A.
Figure 2C:
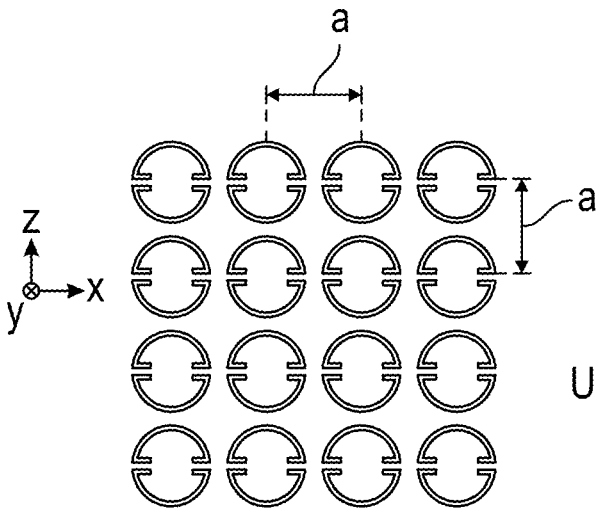
FIG. 2C depicts an array of the conductive resonator of FIG. 2A.
Figure 2D:
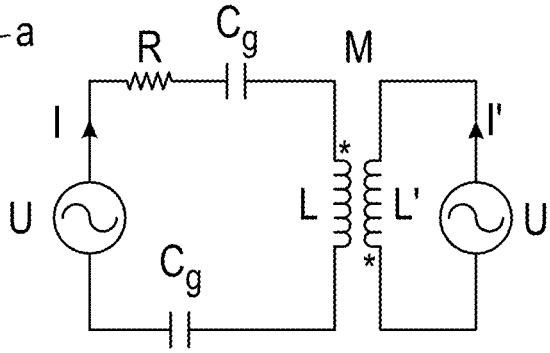
FIG. 2D depicts an equivalent circuit for the conductive resonator of FIG. 2A.
Figure 3A:
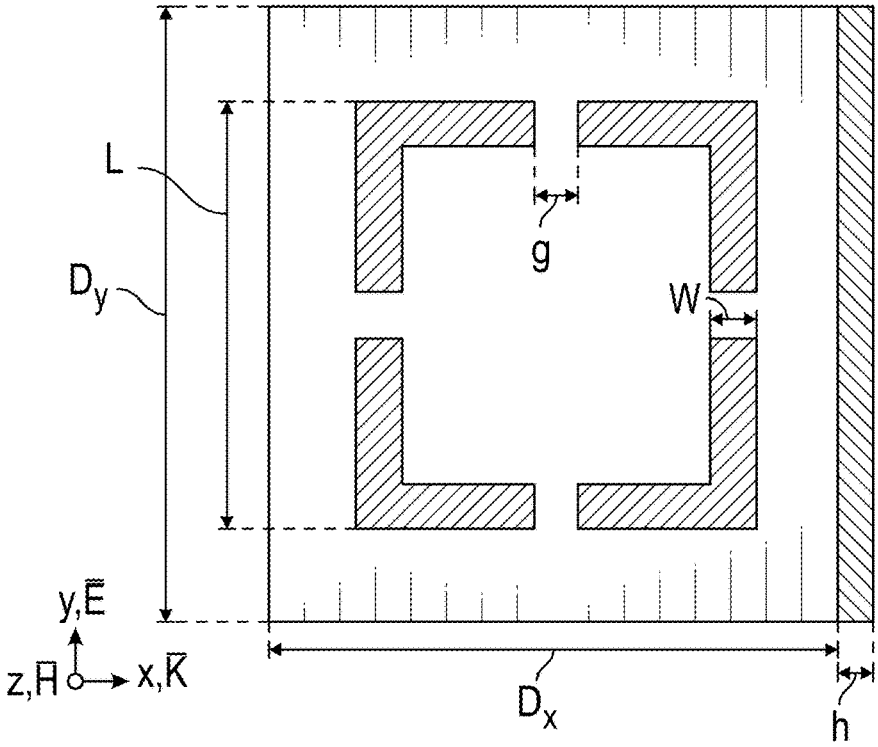
FIG. 3A depicts the geometric parameters of one embodiment of a conductive resonator unit cell.

FIG. 2A depicts an embodiment of a split ring conductive resonator, and FIG. 2B depicts a possible stacking sequence of the split ring conductive resonators. FIG. 2C depicts an embodiment of an array of the split ring conductive resonators, and FIG. 2D depicts an equivalent circuit for the split ring conductive resonator of FIG. 2A. The parameters of the split ring conductive resonators depicted at FIG. 2A, FIG. 2B, and FIG. 2C are r=2 mm, $d_c$=0.2 mm, $L_c$=1 mm, d=0.1 mm, t=0.8 mm, a=5 mm, and l=1 mm; and the gaps may be filled with a dielectric, such as a dielectric having a relative permittivity of $\varepsilon_r$=4.

Figure 3B:
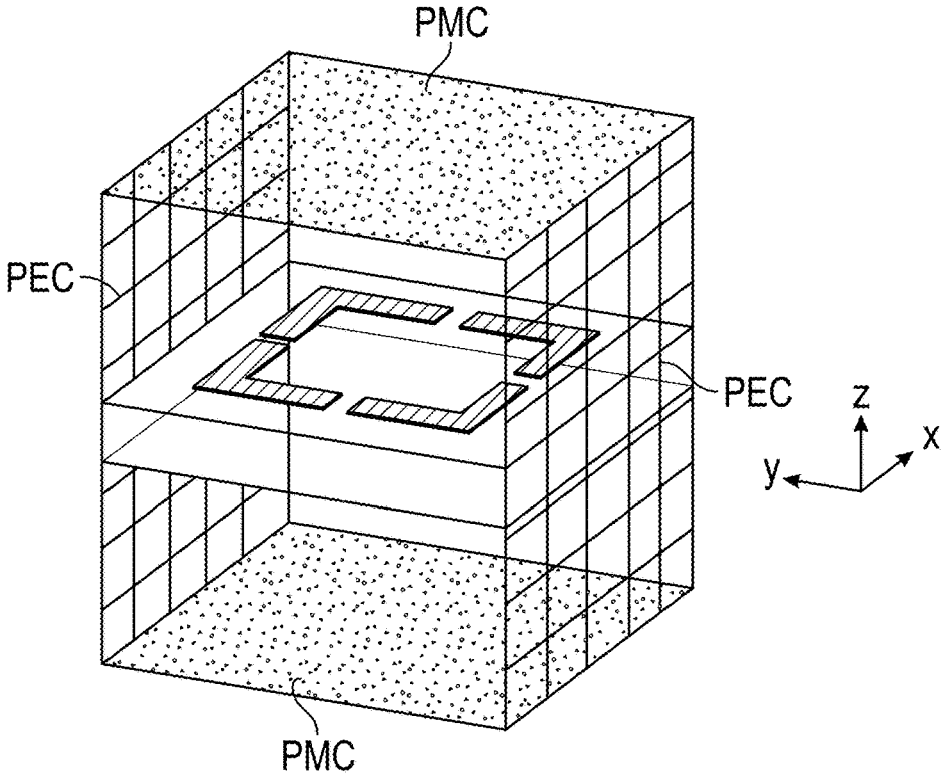
FIG. 3B depicts an embodiment of a High Frequency Structure Simulator (HFSS) simulation setup and boundary conditions.
Figure 3C:
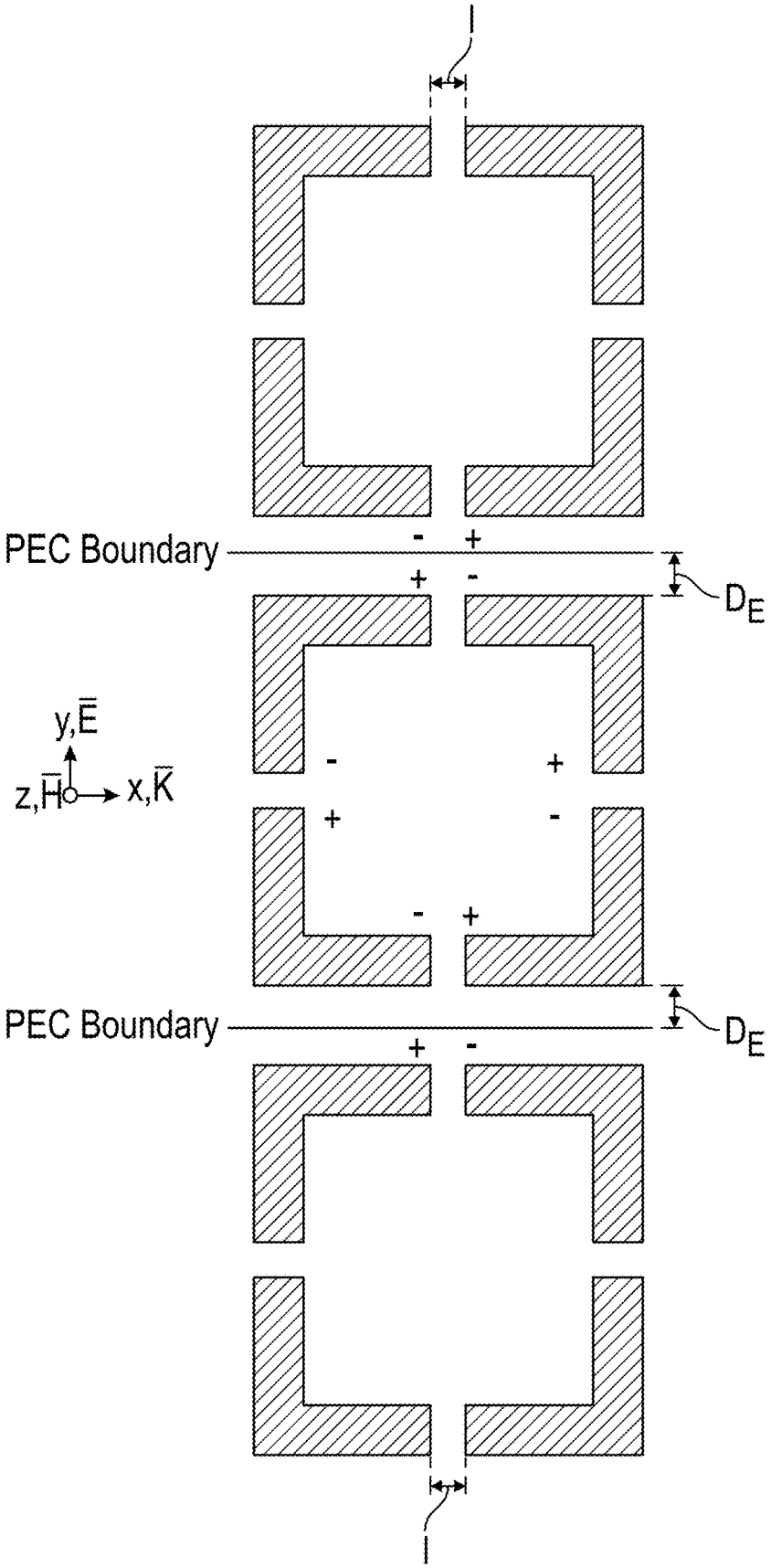
FIG. 3C depicts an embodiment of a two-dimensional periodic split ring resonator array implemented by the use of perfect electric conductor (PEC) and perfect magnetic conductor (PMC) boundary conditions in HFSS.
Figure 3D:
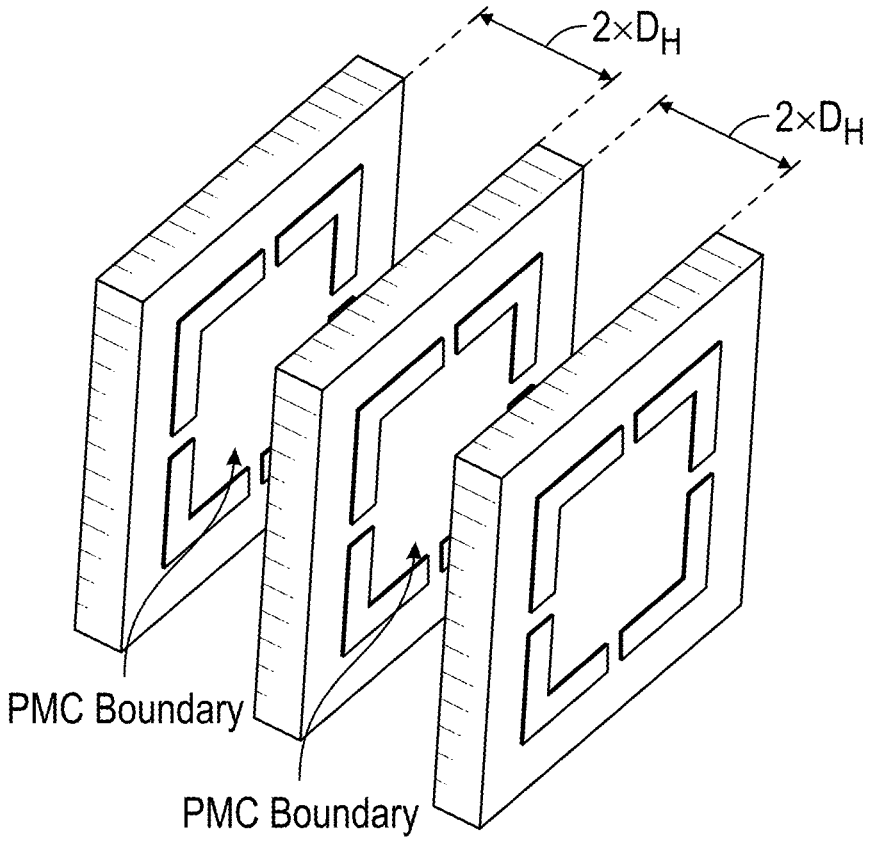
FIG. 3D depicts an embodiment of a array in the H field direction.

FIG. 3A depicts the geometric parameters of an embodiment of a split ring conductive resonator unit cell. FIG. 3B depicts an HFSS simulation setup and boundary conditions; FIG. 3C depicts a two-dimensional periodic array of the split ring conductive resonator of FIG. 3A implemented by the use of PEC and PMC boundary conditions in HFSS. FIG. 3D depicts an embodiment of an array of the split ring conductive resonator of FIG. 3A in the H field direction.

Figure 9A:
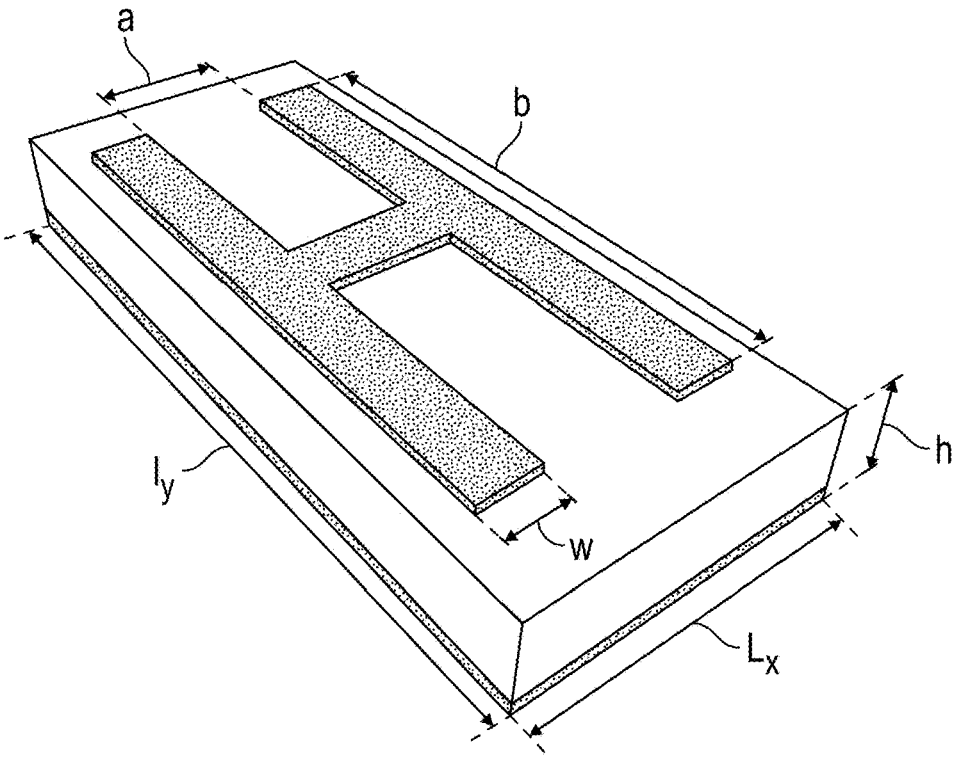
FIG. 9A depicts an embodiment of the geometry of a metasurface unit cell.
Figure 9B:
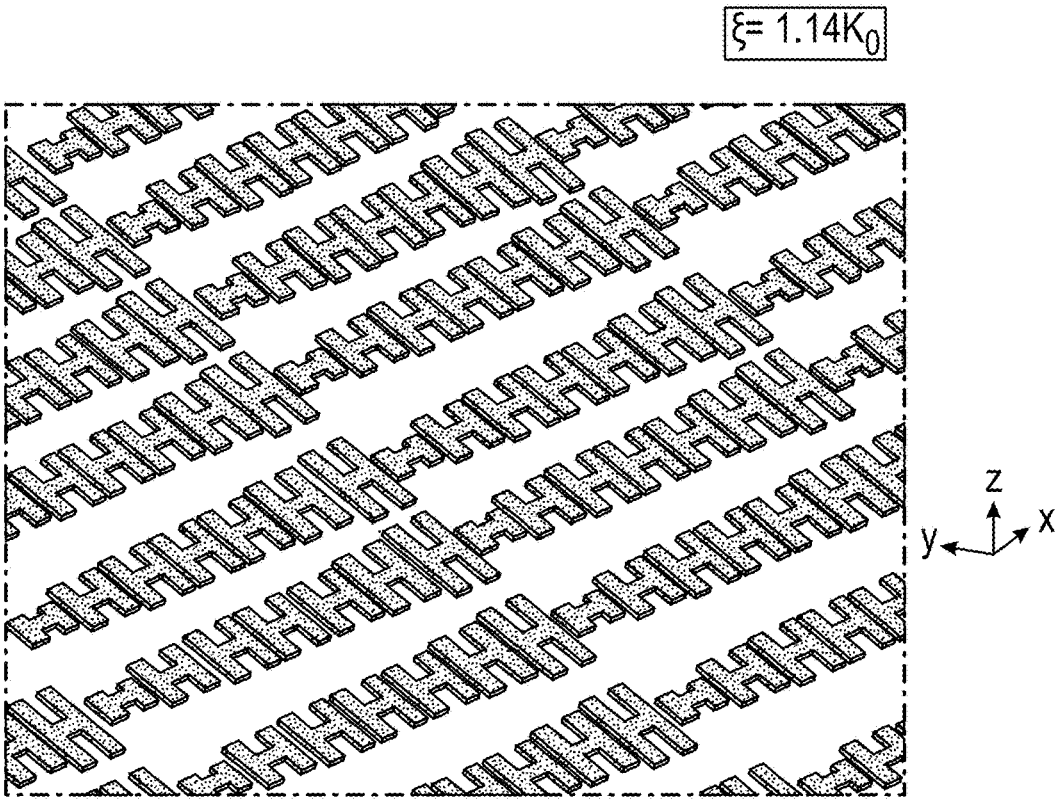
FIG. 9B depicts an embodiment of a patterned metasurface layer.
Figure 9C:
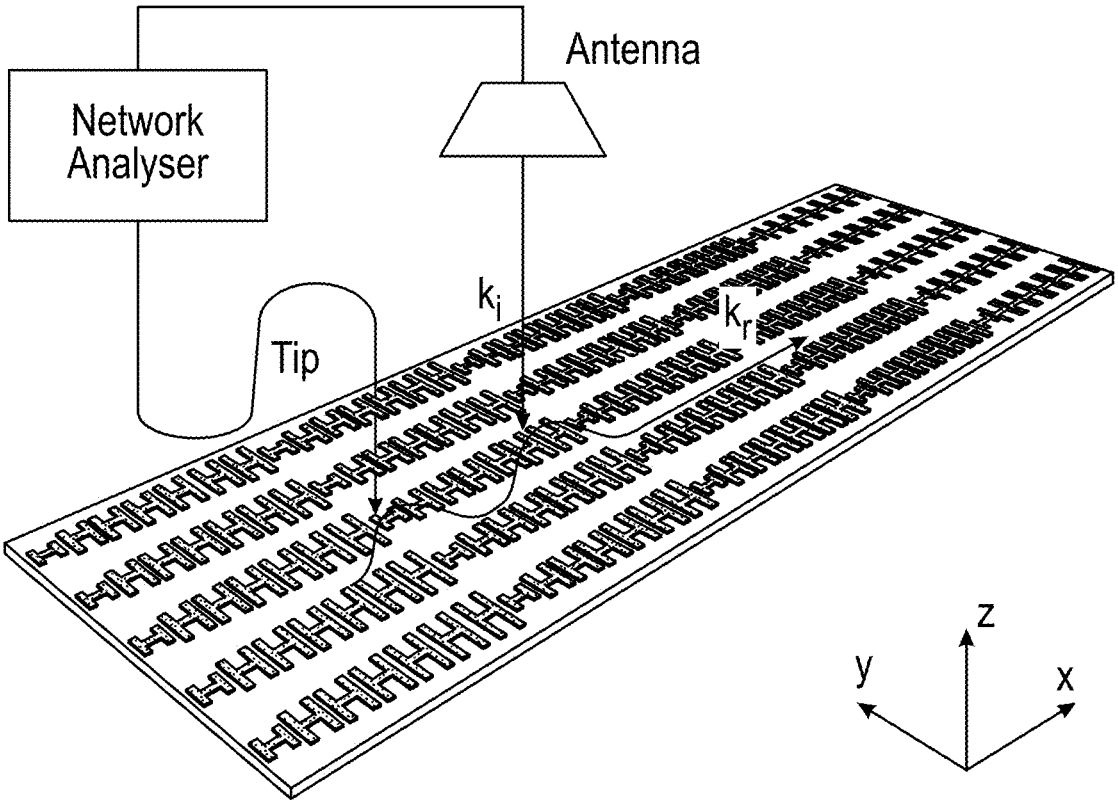
FIG. 9C is a schematic diagram of an experimental setup for detecting anomalous reflection/refraction phenomena.

Other shapes are envisioned for the conductive resonators, including "H"-shaped conductive resonators, such as those depicted at FIG. 9A, FIG. 9B, and FIG. 9C. In some embodiments, the conductive resonators comprise at least one metamaterial structure.

Radomes

Provided herein are radomes that include a metamaterial, as described herein. In some embodiments, the radomes have substantially zero reflection, near-perfect transparency, or both. The metamaterials, in some embodiments, are curved to accommodate the shape of an object, such as a missile or aircraft.

In some embodiments, the radomes include a metamaterial, wherein the metamaterial includes (i) a first substrate including a high temperature dielectric material; and (ii) a first array of conductive resonators arranged on the first substrate, wherein the conductive resonators include a noble metal, a noble metal alloy, a high temperature ceramic semiconductor, or a combination thereof.

In some embodiments, the radomes include a metamaterial, wherein the metamaterial includes (i) a first substrate including a high temperature dielectric material; (ii) a first array of conductive resonators arranged on the first substrate, wherein the conductive resonators include a noble metal, a noble metal alloy, a high temperature ceramic semiconductor, or a combination thereof, (iii) a second substrate including the high temperature dielectric material; and (iv) a second array of the conductive resonators arranged on the second substrate, wherein the first substrate and the second substrate are arranged substantially parallel to each other. In some embodiments, the radomes include an inner wall and an outer wall, wherein the first substrate and the second substrate are arranged between the inner wall and the outer wall.

Not wishing to be bound by any particular theory, it is believed that a radome having a multilayered structure may accommodate objects, such as missiles and aircraft, that operate in a wide range of conditions to maintain their electrical properties, i.e., allowing any combination of RF waves to effectively transmit through the radome.

In some embodiments, the radomes include a multilayered structure that includes a conventional dielectric slab and a metamaterial slab, as described herein. In some embodiments, the radomes include a multilayered structure that includes a conventional dielectric slab and a metamaterial slab of the same width but of one or more opposite material characteristics. Multiple slabs may be manufactured reiteratively as a sandwich structure.

The radomes provided herein may be suitable for a number of industries, including the air and space industry and energy industry. The energy industry, for example, may use the radomes on or as part of equipment used to monitor fuel cell degradation or the temperature inside nuclear reactors. The air and space industry may use the radomes on missiles, or aircraft, particularly high speed aircraft.

The terms "a," "an," and "the" are intended to include plural alternatives, e.g., at least one. For instance, the disclosure of "a substrate," "a noble metal," and the like, is meant to encompass one, or mixtures or combinations of more than one substrate, noble metal, and the like, unless otherwise specified.

In the descriptions provided herein, the terms "includes," "is," "containing," "having," and "comprises" are used in an open-ended fashion, and thus should be interpreted to mean "including, but not limited to." When methods or systems are claimed or described in terms of "comprising" various components or steps, the methods or systems can also "consist essentially of" or "consist of" the various components or steps, unless stated otherwise.

Various numerical ranges may be disclosed herein. When Applicant discloses or claims a range of any type, Applicant's intent is to disclose or claim individually each possible number that such a range could reasonably encompass, including end points of the range as well as any sub-ranges and combinations of sub-ranges encompassed therein, unless otherwise specified. Moreover, all numerical end points of ranges disclosed herein are approximate.

Many modifications and other implementations of the disclosure set forth herein will be apparent having the benefit of the teachings presented in the foregoing descriptions and the associated drawings. Therefore, it is to be understood that the disclosure is not to be limited to the specific implementations disclosed and that modifications and other implementations are intended to be included within the scope of the appended claims

EXAMPLES

The present invention is further illustrated by the following examples, which are not to be construed in any way as imposing limitations upon the scope thereof. On the contrary, it is to be clearly understood that resort may be had to various other aspects, embodiments, modifications, and equivalents thereof which, after reading the description herein, may suggest themselves to one of ordinary skill in the art without departing from the spirit of the present invention or the scope of the appended claims. Thus, other aspects of this invention will be apparent to those skilled in the art from consideration of the specification and practice of the invention disclosed herein.

Example 1—Measurements and Characterization

The metamaterials and radomes described herein may be analyzed and/or characterized according to the descriptions of this example.

i. Effective Refractive Index

The generic forms of the frequency-dependent material parameters can be determined as:

(1) effective permeability:

$$\mu_{eff}(\omega) = 1 - \frac{\omega_{mp}^2 - \omega_{mo}^2}{\omega^2 - \omega_{mo}^2 + i\gamma\omega} \tag{1}$$

where $\omega_{mo}$ is the magnetic resonance frequency (or, the low-frequency edge of the magnetic forbidden band), and $\omega_{mp}$ is the magnetic plasma frequency.

(2) effective permittivity:

$$\varepsilon_{eff}(\omega) = 1 - \frac{\omega_{ep}^2 - \omega_{eo}^2}{\omega^2 - \omega_{eo}^2 + i\gamma\omega} \tag{2}$$

where $\omega_{eo}$ is the electronic resonance frequency (or, the low-frequency edge of the electrical forbidden band), and $\omega_{ep}$ is the electronic plasma frequency.

With a split-ring resonator (SRR) structure, the effective permeability can be calculated as:

$$\mu_{eff}(\omega) = 1 - \frac{\frac{\pi r^2}{a^2}}{1 + \frac{2\sigma i}{\omega r \mu_0} - \frac{3dc_0^2}{\pi^2\omega^2 r^3}} \quad (3)$$

where $$i = \sqrt{-1},$$

$$F = \frac{\pi r^2}{a^2}$$

is the fractional volume of the conductive resonators occupied in the entire structure, $\sigma$ is the DC electrical resistance of the conductive resonator per unit area, $\mu_0$ is the permeability of free space, $\mu_0=4\pi\times10^{-7}$ H/m, $c_0$ is speed of light in free space, $c_0=3\times10^8$ m/s, r, a, d are the geometric dimensions of the split-ring resonator (shown in FIG. 1A).

Therefore, by manipulating the electrical properties and geometric parameters of the split-ring resonator (SRR) structure, the effective permeability $\mu_{eff}(\omega)$ can be adjusted at the interested frequency band, so does the effective permittivity $\varepsilon_{eff}(\omega)$. As described by Snell's law, $$n_i \sin\theta_i = n_r \sin\theta_r \quad (4)$$

where $n_i$ is the refractive index of the incident wave, $\theta_i$ is the angle of the incident wave, $n_r$ is the refractive index of the refracted wave, $\theta_r$ is the angle of the refracted wave.

When the effective refractive index $n_{r_eff}=\sqrt{\mu_{eff}\varepsilon_{eff}}$ is close to the refractive index in the free space $n_i=1$, the refracted angle $\theta_r$ will be equal to the incident angle $\theta_i$, and therefore the beam profile of the transmitted RF wave can be maintained.

ii. Low Loss Transmission

Equation (3) describes the effective permeability of a typical split-ring resonator (SRR) structure, which is a complex number:

$$\mu_{eff}(\omega)=\mu'_{eff}(\omega)-i\mu''_{eff}(\omega) \quad (5)$$

The ratio of the imaginary to the real part of the complex permeability is called the loss tangent:

$$\tan\delta = \frac{\mu''_{eff}(\omega)}{\mu'_{eff}(\omega)} \quad (6)$$

which provides a measure of how much power is lost in a material versus how much it is stored. Similar to other properties described herein, the loss tangent (tan $\delta$) can be adjusted by manipulating the electrical properties and geometric parameters of a split-ring resonator (SRR) structure at the interested frequency band. Therefore, a minimization of the effects of reflection, absorption and scattering can be achieved when an RF signal passes through a material, while maintaining the amplitude of the transmitted RF signal.

iii. RF Transparency

The electrical properties of ceramic materials and RF transmission of the fabricated metamaterials can be examined with a network analyzer from room temperature to high temperature, up to 2500° C., such as a PXI network analyzer: Keysight M9375A, measurement frequency from 300 kHz to 26.5 GHz.

iv. Permeability of Split Ring Resonators

FIG. 2A, FIG. 2B, and FIG. 2C present another type of circular split-ring resonator (SRR) structure (Chen, H. et al., J. Applied Physics, 2006, 100, 024915). The unit cell in FIG. 2A can be modeled as the equivalent circuit shown in FIG. 2D, where $C=C_g/2$ is the total capacitance in the loop, $R=2\pi r\sigma$ is the resistance, $\sigma$ is the resistance per unit length of the ring, $L=\mu_0\pi r^2/l$ is the inductance for a SRR unit, and $F=\pi r^2/a^2$ a is the fractional volume of the periodic unit cell occupied in the entire structure. Based on these parameters, the effective permeability can be calculated as:

$$\mu_{eff}(\omega) = 1 - \frac{F}{1 - \frac{1}{\omega^2 LC} + i\frac{R}{\omega L}} \quad (7)$$

and $$\omega_{mo} = \frac{1}{\sqrt{LC}}$$

is the magnetic resonance frequency, $$\omega_{mp} = \frac{1}{\sqrt{LC(1-F)}}$$

is the magnetic plasma frequency.

The effective permeability $\mu_{eff}(\omega)$ calculated by the equivalent lumped circuit modeling (ELCM) method was compared with that obtained from the traditional electromagnetic numerical simulation method, and the results match closely.

v. Electrical Properties

It should be noted that the electrical properties of the materials may change with elevated ambient temperature and post processing conditions. For example, SiC is a material whose conductivity increases with increasing pyrolysis temperature, while it decreases with elevated testing temperature. Therefore, the effective permittivity $\varepsilon_{eff}$, permeability $\mu_{eff}$, resonance frequency $\omega_{mo}(\omega_{eo})$ and plasma frequency $\omega_{mp}$ $(\omega_{ep})$ can all shift away from their room-temperature values. The frequency-dependent RF signal transmission/reflection behavior can be examined with network analyzer at both room and high temperatures.

The interested beam frequency can be limited within a certain temperature range. With elevated application temperature, both carriers' concentration and mobility increase, which in turn can affect the constitutive parameters and can cause unwanted variations in the beam. It can be determined how much the frequency band shifts due to the changes in the electrical properties of the resonator and dielectric materials.

vi. Mathematical Modeling

Mathematical modeling can be used for structure design and property predictions of metamaterials. Modeling of metamaterials can be generally guided by effective medium theory (EMT)(Zhang, X., et al., Scientific Reports 5, Article Number 7892(2015)).

EMTs for electromagnetic metamaterials can be categorized into several approaches: (1) Obtaining effective parameters from the averaging of the computed eigenfields in the unit cell to produce inherently nonlocal parameters dependent on both frequency and block wave parameters. This method can be suitable for metamaterials with complicated unit structures, such as split rings. (2) Coherent potential approximation (CPA) method whereas effective media is taken as the background embedded with the scattered in the unit cell while implying zero scattering. (3) The multiple-scattering theory (MST) for calculating effective wave speed even with the impedance being unknown. Notable metamaterial modeling methods include Finite-difference time-domain method (FDTD) and Characteristics Basis Function Method (CBFM). For quick design of metamaterials, the LC circuit modeling can be performed together with other modeling methods such as FDTD to determine the resonance frequency and bandwidth of metamaterial emission and absorption (Bilotti, F., IEEE Transactions on Microwave Theory and Techniques, 2007, 55, 2865-73).

vii. Square-shaped Split Ring Resonator

A square-shaped single-ring SRR unit cell can be modeled by the Ansoft's HFSS software over the frequency range from 30 GHz to 40 GHz, using a two-port resonant circuit representation that accounts for the conductor loss and dielectric loss effects (FIG. 3A, FIG. 3B, FIG. 3C, and FIG. 3D)(Yasar-Orten, P. et al., PIERS Proceedings, Cambridge, USA, Jul. 5-8, 2010). A low loss dielectric material with relative permittivity ($\varepsilon_r$=4.6) and dielectric loss tangent (tan $\delta$=0.01) has been used as the substrate. The perfect electric conductor (PEC) type boundary conditions have been applied at those surfaces of the computational volume which are perpendicular to the incident electric field vector. Similarly, perfect magnetic conductor (PMC) type boundary conditions have been applied at those surfaces of the computational volume which are perpendicular to the incident magnetic field vector.

When forming an SRR array by repeating the pattern of single-ring SRR unit cell, the computed transmission spectrum (e.g., magnitude of the $S_{21}$ parameter as a function of frequency) can be calculated by HFSS software for various combination of material electrical properties and geometric parameters. For example, the resonance frequency of the SRR array can be adjusted from 31 GHz to 34 GHz when the periodicity $D_E$ is decreased from 1.2 mm to 0.6 mm. Similarly, when the electrical resistivity ($\sigma$) of the conductive resonator material, relative permittivity ($\varepsilon_r$), or dielectric loss tangent (tan $\delta$) of the dielectric substrate changes, the effect on changes of resonance frequency $\omega_{mo}(\omega_{eo})$ and plasma frequency $\omega_{mp}$ ($\omega_{ep}$) can be simulated in the HFSS software.

viii. Parameter-Condition Performance Database Based on Artificial Intelligence

The relationship among resonance frequency and RF transparency efficiency at elevated ambient temperature for the high-temperature-capable metamaterial systems described herein was determined. Artificial intelligence (AI), therefore, may be used as a tool to setup a parameter-condition-performance database. Neural Networks (NN) can provide a good way to model complicated system behavior, where, in this example, the inputs are the desired working frequency band, allowable RF transparency efficiency, and the estimated working temperature. Through autonomous learning and training, the required material system can be obtained, which can indicate the applicable high temperature dielectrics and resonator materials, and the geometric parameters of the metamaterials (e.g., length, width, gap of the split-ring resonator structure). In this way, the desired RF transparency within a certain frequency band can be ensured in each temperature setting (which can correspond to specific Mach number speed).

ix. Nosecone Radome Design

For airborne nosecone radome design (e.g., for seeker antennas), the cross-section of an airborne radome can be determined based on the super-spheroids geometry profile. The radome can have sufficient flexural strength and fracture resistance to withstand the aerodynamic forces while offering minimal aerodynamic resistance.

Figure 4A:
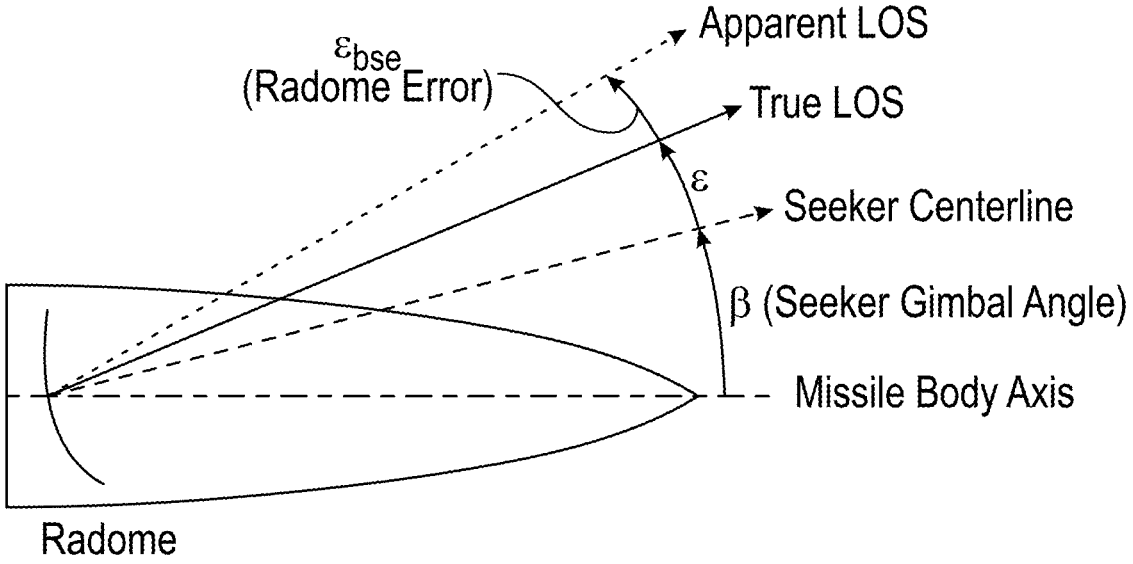
FIG. 4A depicts a boresight error induced by an embodiment of a nosecone radome.
Figure 4B:
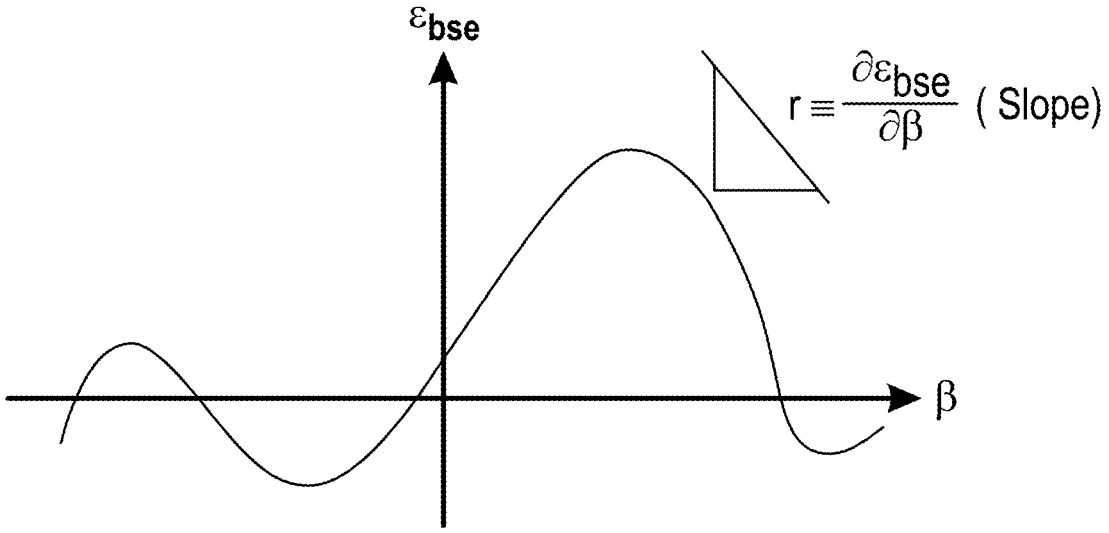
FIG. 4B depicts a boresight error as a function of seeker look angle for an embodiment of a nosecone radome.

During final engagement, as an EM signal passes through a radome, it is refracted by a certain angle which depends on the seeker look angle, $\beta$, as depicted at FIG. 4A. The radome can distort the boresight error measurement by an amount of $\varepsilon_{bse}$, which is a function of $\beta$ (FIG. 4B). The slope $$r = \frac{\partial \varepsilon_{bse}}{\partial \beta}$$

may be location-dependent over the entire radome. The magnitude of boresight error $\varepsilon_{bse}$ can depend on many factors, including, but not limited to, radome shape/thickness/material, operating frequency/temperature, etc.

In order to eliminate such a boresight error $\varepsilon_{bse}$ and ensure accuracy during final engaging/homing, an augmented-metasurface design method can be used that is based on metamaterial theory. Metasurface concept can be used in a wide frequency range from low microwave to optical frequencies, including controllable "smart" surfaces, ultra-compact cavity resonators, novel wave-guiding structures, EM wave absorbers, etc. Metasurfaces can enable advisory control of spatial, spectral, topological, and polarization properties of light by introducing abrupt phase shifts (also denoted as phase discontinuity) over the scale of the wavelength along the optical path. In metasurface design, the Snell's law of refraction and reflection can be generalized as:

$$\sin(\theta_t)n_t - \sin(\theta_i)n_i = \frac{\lambda_0}{2\pi}\frac{d\phi}{dx} \quad (1)$$

$$\sin(\theta_r) - \sin(\theta_i) = \frac{\lambda_0}{2\pi n_i}\frac{d\phi}{dx} \quad (2)$$

where $\theta_t$ is the angle of refraction, $\theta_r$ is the angle of reflection, $\Phi$ and $\Phi+d\Phi$ are the phase discontinuities at the locations where the two paths cross the interface, dx is the distance between the crossing points, $n_i$ and $n_t$ are the refractive indices of the two media. These equations imply that the refracted and reflected beams can be controlled by properly designing and engineering the surface with a thin conductive antenna array so that the EM energy can be manipulated to propagate only along and within the surface as plane waves. Such an artificially-designed metamaterial system is referred to herein as an augmented-metasurface.

x. Testing of Nosecone Radomes

Figure 5:
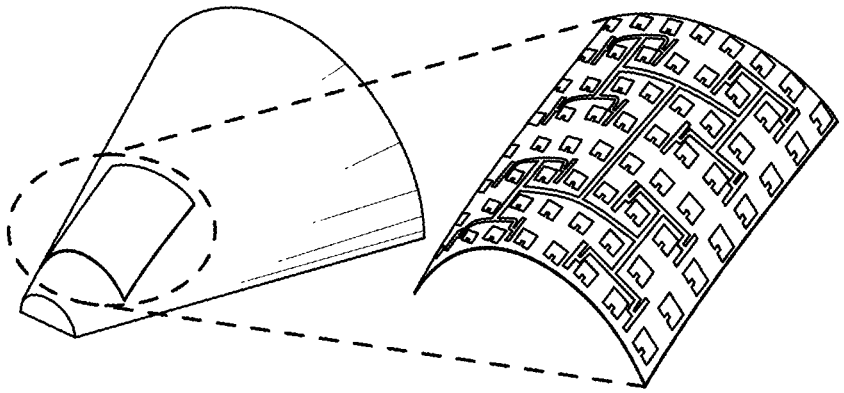
FIG. 5 depicts an embodiment of a conformal antenna design to fit a curvature of a missile, satellite, or aircraft.

An EM signal can be sent from a seeker antenna along a radome surface toward the nose cone direction looking ahead, and the antenna array can be arranged along the longitudinal direction using conformal antenna design, as depicted at FIG. 5. Most common nose shapes are conical, tangent, or secant ogive, elliptical or hemispherical, parabolic series, etc. For airborne radomes, the shape is often chosen to be a tangent ogive design to withstand aerodynamic drag.

Figure 7A:
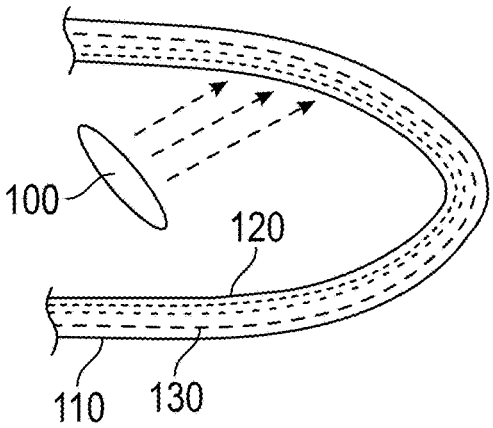
FIG. 7A depicts an embodiment of a radome structure having a layered wall.

The geometry of an augmented-metasurface device can be designed to have an ogive curvature, and act as a function-tunable waveguide, as depicted in cross-section at FIG. 7A.

Such a design can be able to provide end-fire radiation pattern (as depicted at FIG. 7A) and EM energy can travel through the "thin" array of conductive antennas. FIG. 7A depicts an antenna plate 100, an outer layer 110, inner layers 120, and a metasurface 130 designed with layers of relatively thin antenna arrays.

Figure 6A:
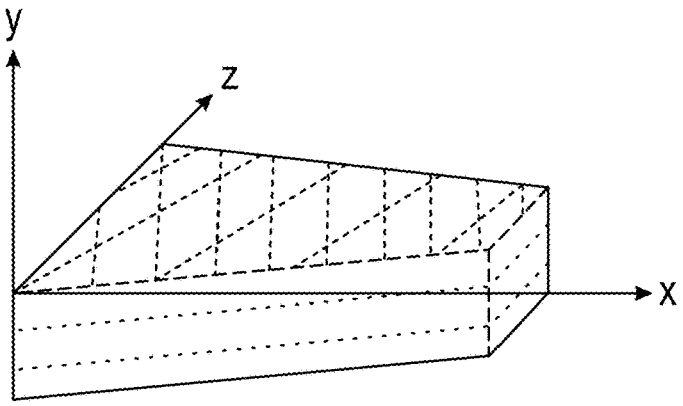
FIG. 6A depicts an embodiment of a metasurface-filled function-tunable waveguide.
Figure 6B:
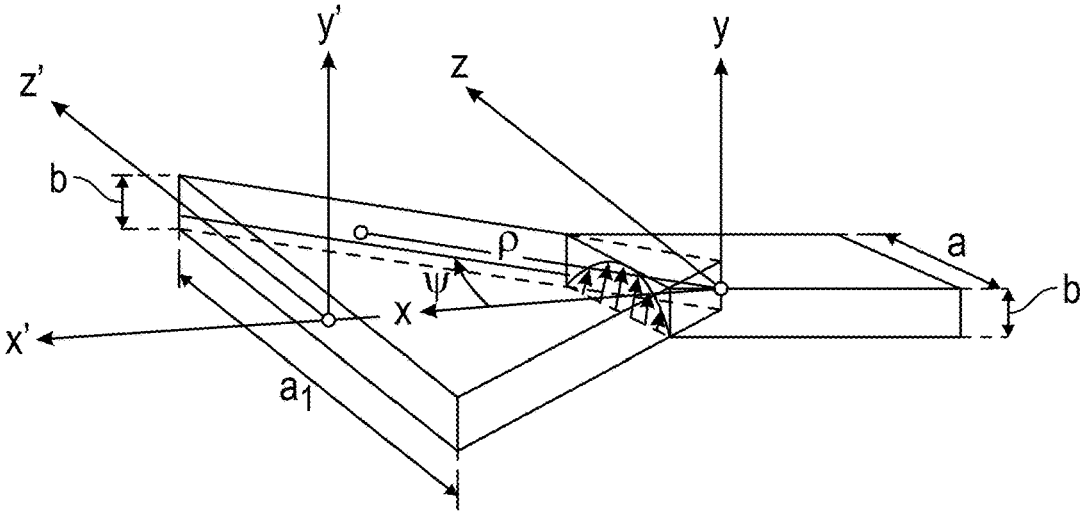
FIG. 6B depicts an embodiment of an H-plane sectoral horn.

The concept of the pyramidal shape can be similar to that of a horn antenna (FIG. 6B). The dimension can taper down as the radial diameter of radome reduces to guide the EM energy propagating along the looking-forward direction (FIG. 7A). The geometry and dimensions of the taper degree can be part of the key parameters in the augmented-metasurface design which may have a dominant effect on the overall performance.

Assuming the thickness of the overall radome wall structure is constant, similar to tapering down the dimensions of a rectangular waveguide in the direction of the H-field, while keeping the other constant, an H-plan sectoral horn (geometric illustration provided in FIG. 6B) can be formed and the EM theories can still be applicable. For a typical H-plane sectoral horn antenna, the far-zone electric field components radiated can be determined as:

$$E_r = 0$$

$$E_\theta = jE_2\frac{b}{8}\sqrt{\frac{k\rho_2}{\pi}}\frac{e^{-jkr}}{r}\times\left\{\sin\phi(1+\cos\theta)\frac{\sin Y}{Y}\left[e^{if_1}F(t_1',t_2')+e^{if_2}F(t_1'',t_2'')\right]\right\}$$

$$E_\phi = jE_2\frac{b}{8}\sqrt{\frac{k\rho_2}{\pi}}\frac{e^{-jkr}}{r}\times\left\{\cos\phi(\cos\theta+1)\frac{\sin Y}{Y}\left[e^{if_1}F(t_1',t_2')+e^{if_2}F(t_1'',t_2'')\right]\right\}$$

During hypersonic flight operations, because of the large temperature gradient across the radome wall, a pyramidal shaped waveguide (FIG. 6A) can be designed as a layered structure. Each layer can be made with the augmented-metasurface design method and can include an optically thin, strongly-coupled nanorod array so that both the refracted and reflected signals can stay inside the metasurface and propagate along and stay within the surface. In each layer of such a structure, the concentration (and therefore the inter-spacing), geometry, dimensions, and orientation of such conductive antenna arrays can be key parameters in augmented-metasuface design to guide the propagation of the EM signal. It can be possible to improve the field-of-view up to ±45°, which is a typical scan angle for radome antenna setting.

Embodiments of antenna arrays are depicted at FIG. 8A and FIG. 8B.

By such a design, EM energy can travel through a missile's longitudinal direction and not through the thickness of the radome. The boresight error $\varepsilon_{bse}$ can be the main indicator to quantify the success of the proposed work. A aboresight error $\varepsilon_{bse}$ can be eliminated, thereby ensuring accuracy during final engaging/homing.

RF transmission of fabricated metasurface materials can be examined with a network analyzer (e.g., 3-30 GHz) at both ambient and high temperatures (e.g., 1000-1400° C.). Experiments can characterize the candidate materials, evaluate the metasurface design and measure RF transparency performance.

xi. Range of Critical Incident Angle

As depicted at FIG. 7A, an EM signal sent from the seeker antenna can have a certain incident angle entering the radome inner surface. Both the refracted and reflected beams can be manipulated, as described herein, to propagate only along and within the radome surface. The foregoing equation (1) implies that the refracted beam can have an arbitrary direction, provided that a suitable constant gradient of phase discontinuity along the interface $$\left(\frac{d\phi}{dx}\right)$$

is introduce; and equation (2) predicts that there may always be a critical angle of incident angle $$\theta_c' = \arcsin\left(1-\frac{\lambda_0}{2\pi n_i}\left|\frac{d\phi}{dx}\right|\right),$$

above which the reflected beam may become evanescent. Assuming that $\phi$ is a continuous function of the position along the interface, all of the incident energy can be transferred into the reflection/refraction which propagate(s) only along and within a radome surface.

Figure 8C:
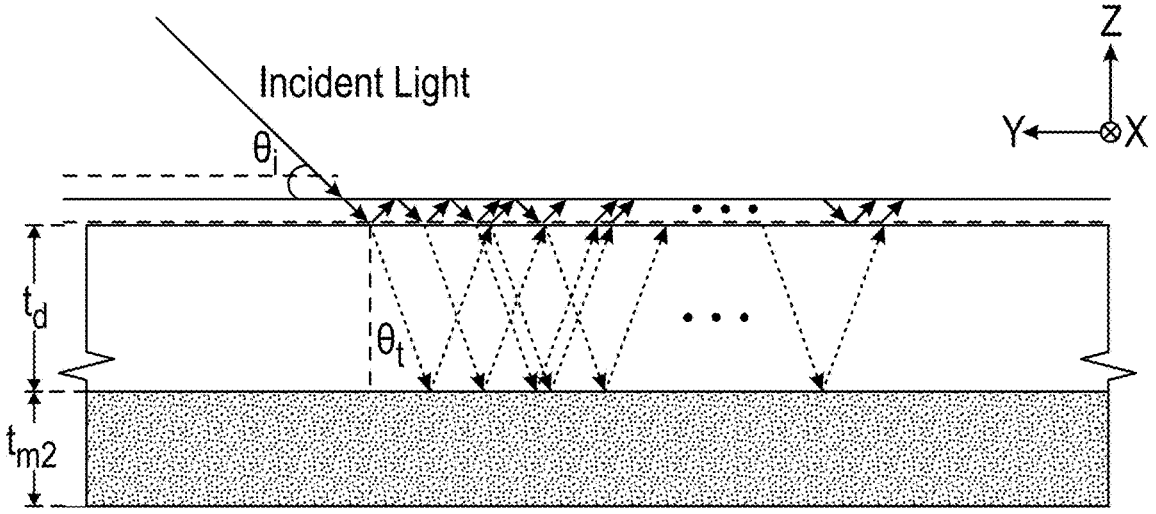
FIG. 8C depicts an embodiment of an interference model for evaluating the optical response of an embodiment of a multilayer structure based on the surface polarizability tensor parameters of a metasurface.

FIG. 8B depicts one embodiment of a metasurface designed and fabricated with multiple layers, where the optically thin strongly-coupled nanorod array is used to realize the metasurface. Such plasmonic metasurface-based nanostructures can achieve high-efficiency and angle-insensitive polarization transformation. The interference of light can be tailored at the subwavelength scale and the field-of-view can be up to ±40°. As depicted at FIG. 8C, the refracted signal can stay in the $SiO_2$ layer and there may be only reflected light coming out of this metasurface device. This design can be augmented by adding another layer of metasurface pattern (such as a mirror-pattern design) on the top, so that the reflected signal can also stay inside the $SiO_2$ layer (or the Au layer) and overall will propagate to the right-hand side direction.

Example 2—Metasurface Patterning and Design in RF Frequency Range

Metasurface design can be used in a wide frequency range, from low microwave to optical frequency. Theory and implementation in RF frequency range for radome applications (e.g., 3-30 GHz) has not been explored. Optically visible and near IR wavelength metamaterial design can be technically challenging since the structural units must be in sub-micron or nanometer scale. To accommodate EM spectrum with wavelengths of 1-10 cm ($1/100^{th}$ wavelength 0.1-1 mm), complex-structured subwavelength units in millimeter and micron-size range can be with current manufacturing technologies.

"Thin" arrays of such antenna arrays can be made of silicon carbide (SiC) fiber. SiC is stable up to 1700° C. in air and becomes a semiconductor at high temperature. SiC fibers in general have good mechanical properties and are commercially available from a number of companies. Diameters in the range of a nanometer to several micrometers can be used. By patterning and fabricating such SiC fibers within radome wall structure, a desired phase change can be achieved along the interface so that both reflection and refraction beams are in the format of plane waves to propagate. Pt—Rh alloy resonator patches can be deposited on alumina by screen printing of powder slurries followed by high temperature baking (up to 2000° C.).

The building block of embodiments of the metasurface design is a sandwich structure that includes "thin" arrays (thickness and width separation are in sub-wavelength in RF frequency range) made of conductive antennas, patterned within layers of the radome wall structure (as shown, for example, at FIG. 7A) and oriented in such a way so as to introduce anomalous reflection and refraction phenomena.

During hypersonic flight operations, the temperature of the outer surface of the radome wall can be much higher than that of the inner surface, due to extreme aerodynamic drag. Under such conditions, the large temperature gradient existing across a radome wall can result in variations in the required dielectric properties (e.g., dielectric constant and loss tangent) of the radome wall and hence radome EM performance requirement. A possible advantage of using a layered-structural design for a radome wall can be that the concentration (and therefore the inter-spacing) among each "thin" antennas can be designed in such a way that the changes of electrical conductivity (and/or permittivity) of both the dielectrics and the resonator materials are considered to fit the metasurface design requirement at that temperature.

Figure 7B:
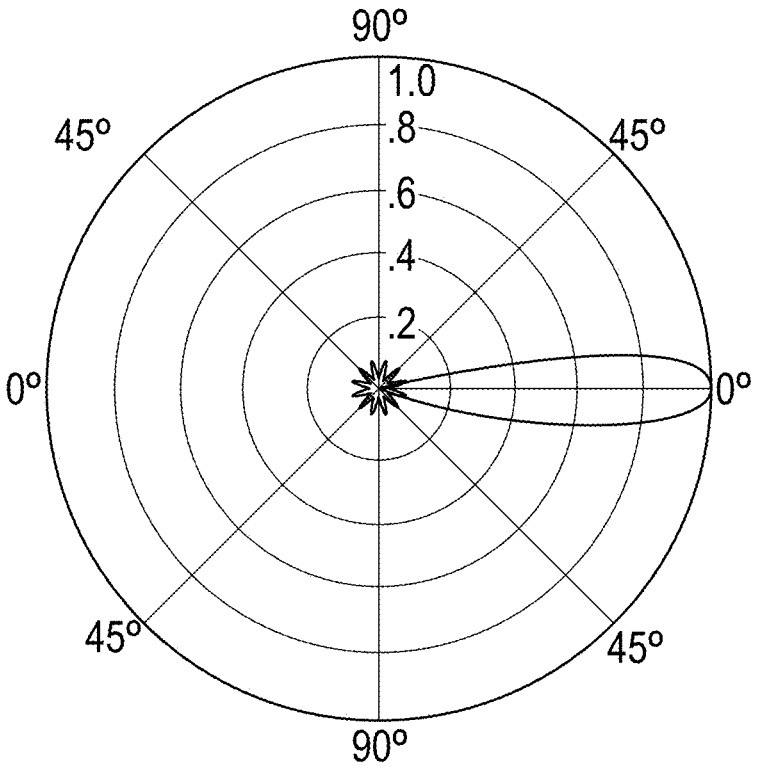
FIG. 7B depicts an embodiment of an end-fire pattern of electromagnetic signal propagation.

An entire metasurface functional device can be designed to be a pyramidal-shaped waveguide (e.g., FIG. 6A, filled with layers of a "thin" array of conductive antennas), constructed as the radome wall structure (FIG. 7A), conformally-arranged along the radome wall with dimension tapering down toward the nose cone direction. Such a unique design can be able to provide end-fire radiation pattern (e.g., FIG. 7B) and EM energy can travel through the "thin" array of conductive antennas, ensuring forward-looking coverage. EM signals not sent through the thickness direction effectively eliminate the boresight error $\varepsilon_{bse}$ and can ensure or improve accuracy during final engaging/homing.

FIG. 9A, FIG. 9B, and FIG. 9C depict a representative example of using a metallic "H" and a continuous metal sheet, which are separated by a dielectric (electrically insulating) spacer to achieve the anomalous changes in the reflection phase of the incident EM signals.

Example 3—Conformal-Shaped Metasurface Design for Radome/Nosecone

For typical airborne nosecone radome design (e.g., for seeker antennas), the cross-section of an airborne radome can be determined based on the super-spheroids geometry profile. In order to fit the curvature of the radome, a thermally stable RF transparent material can be examined based on ceramic metasurface design with embedded RF antennas/resonators and a ceramic green tape compression molding process for low cost near net shape manufacturing.

The structure can be based on high-purity silicon nitride (or similar) material which is manufactured with a green tape compression molding process. This process can be performed by laminating layers of ceramic (which may have very precise thickness) in a high-pressure net shape mold. Resonators can be designed and incorporated into the tape prior to laminating. Once the resonators are incorporated into a flat tape, the material can be draped or molded to fit the shape of a conformal radome.

Using laminating and compression molding processes via pre-polymer ceramics route, thin walled net shaped green bodies of complex shapes can be fabricated to achieve high density ceramic radome structure.

That which is claimed is:

1. A radome comprising:

a metamaterial, wherein the metamaterial comprises (i) a first substrate comprising a high temperature dielectric material; and (ii) a first array of conductive resonators arranged on the first substrate, wherein the conductive resonators comprise a noble metal, a noble metal alloy, a high temperature ceramic semiconductor, or a combination thereof, wherein the metamaterial is thermally stable at a temperature from 1,400° C. to 1,800° C., and wherein the radome is a nosecone radome.

2. The radome of claim 1, wherein the metamaterial further comprises a second substrate comprising the high temperature dielectric material, and a second array of the conductive resonators arranged on the second substrate, wherein the first substrate and the second substrate are arranged substantially parallel to each other.

3. The radome of claim 2, further comprising an inner wall and an outer wall, wherein the first substrate and the second substrate are arranged between the inner wall and the outer wall.

4. The radome of claim 1, wherein the radome has substantially zero reflection and near-perfect transparency.

5. The radome of claim 1, which has multilayered structure that comprises a dielectric slab and a metamaterial slab.

6. The radome of claim 1, wherein the nosecone radome is suitable for hypersonic flight.

7. The radome of claim 1, wherein the radome has a pyramidal shape along an ogive curvature acting as a function-tunable waveguide.

8. The radome of claim 1, wherein the metamaterial is substantially RF transparent.

9. The radome of claim 1, wherein the high temperature dielectric material comprises alumina ($Al_2O_3$), yttria ($Y_2O_3$), silicon nitride ($Si_3N_4$), or a combination thereof.

10. The radome of claim 1, wherein the conductive resonators comprise a noble metal and the noble metal comprises ruthenium (Ru), rhodium (Rh), osmium (Os), iridium (Ir), or platinum (Pt).

11. The radome of claim 1, wherein the conductive resonators comprise a platinum-rhodium alloy.

12. The radome of claim 1, wherein the conductive resonators comprise a high temperature ceramic semiconductor and the high temperature ceramic semiconductor comprises silicon carbide.

13. The radome of claim 1, wherein the conductive resonators comprise at least one split ring conductive resonator.

14. The radome of claim 1, wherein the conductive resonators comprise at least one nanorod conductive resonator.

15. The radome of claim 1, wherein the conductive resonators comprise (i) at least one "H"-shaped conductive resonator or (ii) at least one metamaterial structure.

16. A radome comprising:

a metamaterial, wherein the metamaterial comprises:

a first substrate comprising a high temperature dielectric material;

a first array of conductive resonators arranged on the first substrate;

a second substrate comprising the high temperature dielectric material;

a second array of the conductive resonators arranged on the second substrate;

wherein the metamaterial is thermally stable at a temperature from 1,400° C. to 1,800° C., wherein the first substrate and the second substrate are arranged substantially parallel to each other and wherein the conductive resonators comprise a noble metal, a noble metal alloy, a high temperature ceramic semiconductor, or a combination thereof, and wherein the radome is a nosecone radome.

17. The radome of claim 16, wherein the conductive resonators are selected from the group consisting of (i) platinum, (ii) iridium, (iii) a platinum-rhodium alloy, (iv) silicon carbide, or (v) a combination thereof.

18. The radome of claim 16, wherein the metamaterial is substantially RF transparent.

19. The radome of claim 16, wherein the conductive resonators are substantially aligned in the Z direction.

* * * * *